US012474107B2

(12) United States Patent
Rizzo

(10) Patent No.: US 12,474,107 B2
(45) Date of Patent: Nov. 18, 2025

(54) REFRIGERATING APPLIANCE WITH PRESSURE SENSOR

(71) Applicant: ELECTROLUX APPLIANCES AKTIEBOLAG, Stockholm (SE)

(72) Inventor: Luca Rizzo, Pordenone (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 435 days.

(21) Appl. No.: 18/012,306

(22) PCT Filed: Jun. 30, 2020

(86) PCT No.: PCT/EP2020/068423

§ 371 (c)(1),
(2) Date: Dec. 22, 2022

(87) PCT Pub. No.: WO2022/002377

PCT Pub. Date: Jan. 6, 2022

(65) Prior Publication Data

US 2023/0296306 A1 Sep. 21, 2023

(51) Int. Cl.
*F25D 17/04* (2006.01)

(52) U.S. Cl.
CPC ..... *F25D 17/047* (2013.01); *F25D 2700/02* (2013.01)

(58) Field of Classification Search
CPC ..... F25B 2400/15; F25D 17/047; F25D 2700/02; F25D 29/005
See application file for complete search history.

(56) References Cited

U.S. PATENT DOCUMENTS

2005/0258260 A1* 11/2005 Ahmed ..... F23N 5/20 236/44 C
2010/0307189 A1 12/2010 Keller et al.
2016/0116206 A1 4/2016 Kempfle et al.
2016/0313055 A1* 10/2016 Heydel ..... F25D 23/028
(Continued)

FOREIGN PATENT DOCUMENTS

| | | |
|---|---|---|
| DE | 102006061083 | 6/2008 |
| EP | 3540343 | 9/2019 |
| WO | 2014198634 | 12/2014 |

OTHER PUBLICATIONS

International Search Report for PCT/EP2020/068423, dated Mar. 25, 2021, 3 pages.

*Primary Examiner* — Lionel Nouketcha
(74) *Attorney, Agent, or Firm* — Chrisman Gallo Tochtop LLC

(57) ABSTRACT

A refrigerating appliance (100) is provided. The refrigerating appliance (100) comprises: —at least one storage compartment (110) for storing goods to be refrigerated; —a pressure sensor (180), —a control unit (172) configured to control operation of the refrigerating appliance (100), the control unit (172) being in signal communication with said pressure sensor (180); wherein: —said pressure sensor (180) is a MEMS pressure sensor configured to measure the pressure inside said at least one storage compartment (110) and to transmit to the control unit (172) a corresponding pressure signal proportional to said measured pressure, the control unit (172) being configured to control the operation of the refrigerating apparatus (100) based on the pressure signal received from the pressure sensor (180).

13 Claims, 3 Drawing Sheets

(56) References Cited

U.S. PATENT DOCUMENTS

| | | | | |
|---|---|---|---|---|
| 2016/0333625 | A1* | 11/2016 | Kempfle | E05F 15/60 |
| 2018/0313709 | A1* | 11/2018 | Chiou | B81B 7/0061 |
| 2019/0242772 | A1* | 8/2019 | Duqi | B81B 7/007 |
| 2019/0285331 | A1* | 9/2019 | Kim | F25D 17/06 |
| 2020/0003483 | A1* | 1/2020 | Wilson | F25D 29/00 |

* cited by examiner

REFRIGERATING APPLIANCE WITH PRESSURE SENSOR

FIELD OF THE INVENTION

The present invention generally relates to a refrigerating appliance. More particularly, the present invention relates to a refrigerating appliance equipped with a pressure sensor system.

BACKGROUND OF THE INVENTION

Among the available sensor devices, pressure sensors are sensor devices configured to measure the pressure of gases or liquids. These sensors can be expediently used in a wide range of different applications, such as for example for measuring the pressure inside of spaces (e.g., a room, a compartment, the environment), measuring altitude, measuring the flow of a fluid, and detecting fluid leaks.

Modern refrigerating appliances having one or more storage compartments for refrigerating food and beverage articles can be equipped with one or more sensor devices, configured to measure the pressure inside said one or more storage compartments, and control the operation of the refrigerating appliance according to the measured pressure. For example, a pressure sensor may be used in order to assess a closed/open condition of a storage compartment door based on the measured pressure inside the refrigerating appliance.

According to a solution known in the art, a differential pressure sensor is used, i.e., a kind of pressure sensor that is configured to measure the pressure difference between two different—and separated—environments, and for this reason comprises two ports, each one in fluid communication with a respective one of said two separated environments.

According to this known solution, the differential pressure sensor is arranged in such a way to have a first port in fluid communication with a compartment of the refrigerating appliance, and a second port in fluid communication with the external environment, and the measured output by the pressure sensor is the difference between the pressure of the compartment and the pressure of the external environment.

SUMMARY OF INVENTION

The Applicant has realized that the known solutions for detecting the pressure inside storage compartments of a refrigerating appliance for controlling the operation of the latter are not particularly satisfactory because affected by drawbacks.

The known solutions provide for employing one or more differential pressure sensors to be installed in the refrigerating appliance, in such a way that each differential pressure sensor is able to measure the difference between the pressure inside a respective storage compartment and the pressure of the external environment.

Installing a differential pressure sensor in a refrigerating appliance is however a complicated and time consuming operation.

Indeed, each differential pressure sensor has to be installed in such a way that a first port thereof is in fluid communication with a storage compartment, and the second port thereof is in fluid communication with the external environment. For this reason, tube elements are required to be coupled with the two ports for allowing the fluid communication of the sensor device with the two different environments (storage compartment/external environment), or the pressure sensor need to be placed in a position close to (or astride) both the storage compartment and the external environment. Since the two environments are separated and insulated to each other by means of separator elements, such as frame walls, doors, and/or other elements, additional openings need to be provided in said separator elements, through which at least one of the tubes or the pressure sensor itself have to pass through.

Moreover, by making reference to the case in which the differential pressure sensor is provided with tube elements, the feasible locations for installing a differential pressure sensor in the refrigerating appliance are strongly limited by the intrinsic complexity of the pressure sensor—tube assembly. Similarly, the feasible locations for installing a differential pressure sensor astride the storage compartment and the external environment are limited as well.

Furthermore, undesired leakages may happen at portions of the refrigerator appliance where the differential pressure sensor and/or the tube elements thereof are mounted.

In view of the above, it is an object of the present invention to provide a refrigerating appliance equipped with a pressure sensor system that is not affected by the above-mentioned drawbacks.

More in detail, it is an object of the present invention to provide a refrigerating appliance that is easier to be constructed/assembled, but that is at the same time provided with a pressure sensor having the capability of obtaining a more precise estimation of the pressure inside the storage compartment(s). Moreover, it is an object of the present invention to provide a refrigerating appliance with a pressure sensor that can be easily configured/assembled/constructed and that can be freely placed in the more suitable place inside the storage compartment(s).

One or more aspects of the present invention are set out in the independent claims, with advantageous features of the same invention that are indicated in the dependent claims.

An aspect of the present invention relates to a refrigerating appliance.

According to an embodiment of the present invention, the refrigerating appliance comprises at least one storage compartment for storing goods to be refrigerated.

According to an embodiment of the present invention, the refrigerating appliance comprises a pressure sensor, preferably located inside said at least one storage compartment.

According to an embodiment of the present invention, the refrigerating appliance comprises a control unit configured to control operation of the refrigerating appliance.

According to an embodiment of the present invention, the control unit is in signal communication with said pressure sensor.

According to an embodiment of the present invention, said pressure sensor is a Micro Electro Mechanical System (MEMS) pressure sensor configured to measure the pressure inside said at least one storage compartment and to transmit to the control unit a corresponding pressure signal proportional to said measured pressure.

By MEMS pressure sensor is herein intended a pressure sensor made up of miniaturized electro-mechanical elements (e.g., between 1 and 100 micrometers in size) manufactured using modified semiconductor device fabrication technologies.

Using a MEMS pressure sensor guarantees several advantages, such as, among others, a highly precise output capable of efficiently tracking fast pressure variations, and a limited encumbrance. Moreover, a MEMS pressure sensor requires a simplified installation procedure, and can be easily placed in suitable pressure-sensitive areas of the refrigerator appliance, such as for example in proximity of the refrigerating appliance door. Furthermore, MEMS pressure sensors can be easily constructed.

According to an embodiment of the present invention, the control unit is configured to control the operation of the refrigerating apparatus based on the pressure signal received from the pressure sensor.

According to an embodiment of the present invention, said pressure sensor is an absolute pressure sensor.

In this way, assembling the refrigerating appliance is easier, since (unlike the pressure sensors of the differential type) no additional tube element is required, and there is no constraint about the position in the refrigerating appliance where installing the pressure sensor (because an absolute pressure sensor does not require to be in fluid communication with two different environments).

According to an embodiment of the present invention, the refrigerating appliance further comprises at least one door configured to provide access to said at least one storage compartment when the at least one door is in an open condition and to prevent access to said at least one storage compartment when the at least one door is in a closed condition.

According to an embodiment of the present invention, the control unit is configured to assess whether said at least one door is in the open condition or in the closed condition according to said pressure signal.

According to an embodiment of the present invention, the control unit is configured to assess that said at least one door is passing from the closed condition to the open condition according to said pressure signal, preferably when the pressure signal is indicative of a decrease in said measured pressure.

Thanks to the high precision of the measures carried out by the MEMS pressure sensor, and the fast response speed thereof, the passage between open and closed door conditions is assessed in a fast, precise and reliable way.

According to an embodiment of the present invention, the control unit is configured to assess that said at least one door is passing from the closed condition to the open condition when the pressure signal falls from a steady value to a corresponding lower first pressure threshold value in a time period lower or equal than a corresponding first time threshold.

According to an embodiment of the present invention, said steady value is a value corresponding to an external ambient pressure.

According to an embodiment of the present invention, said steady value is a value corresponding to an average of the pressure inside said at least one storage compartment measured by the pressure sensor within a predefined minimum time.

According to an embodiment of the present invention, said predefined minimum time is equal to 5 seconds.

According to an embodiment of the present invention, the control unit is configured to assess that said at least one door is passing from the open condition to the closed condition according to said pressure signal, preferably when the pressure signal is indicative of an increase in said measured pressure.

According to an embodiment of the present invention, the control unit is configured to assess that said at least one door is passing from the open condition to the closed condition when the pressure signal rises from a steady value to a corresponding higher second pressure threshold value in a time period lower or equal than a corresponding second time threshold.

According to an embodiment of the present invention, said steady value is a value corresponding to an external ambient pressure.

According to an embodiment of the present invention, the refrigerating appliance, further comprises a door actuator adapted to be driven by the control unit for actuating the opening of said at least one door when the pressure signal is indicative of a decrease in said measured pressure.

Thanks to the high precision of the measures carried out by the MEMS pressure sensor, and thanks to the fast response speed of the latter, it is possible to actuate the door at the right moment for providing aid in opening the door.

According to an embodiment of the present invention, the refrigerating appliance further comprises a cabinet enclosing said at least one storage compartment.

According to an embodiment of the present invention, the refrigerating appliance comprises a gasket element mounted along an inner peripheral portion of the at least one door.

According to an embodiment of the present invention, the refrigerating appliance comprises a magnetic coupling element configured to be activated by the control unit for causing said gasket element adhere to a corresponding portion of the cabinet when the at least one door is in the closed condition so as to prevent air in the at least one storage compartment from leaking out of the at least one storage compartment.

According to an embodiment of the present invention, the control unit is configured to deactivate the magnetic coupling element when the pressure signal is indicative of a decrease in said measured pressure.

Thanks to the high precision of the measures carried out by the MEMS pressure sensor, and the fast response speed thereof, it is possible to deactivate the magnetic coupling element at the right moment for providing aid in opening the door.

According to an embodiment of the present invention, said pressure signal is a digital signal.

According to an embodiment of the present invention, the refrigerating appliance further comprises at least one electronic printed circuit board provided inside said at least one storage compartment. Thanks to the small encumbrance of the MEMS pressure sensor, and thanks to the absence of particularly constraints about the position where installing the MEMS pressure sensor in the refrigerating appliance, the MEMS pressure sensor can be easily installed/integrated in/on supports/boards already used for/by other electric/electronic components of the refrigerating appliance.

According to an embodiment of the present invention, said pressure sensor is mounted on said at least one electronic printed circuit board.

According to an embodiment of the present invention, said at least one storage compartment comprises a fresh food compartment and a freezer compartment.

According to an embodiment of the present invention, said pressure sensor is located inside the fresh food compartment and/or in the freezer compartment.

According to an embodiment of the present invention, the refrigerating appliance further comprises at least one defrost heater in signal communication with the control unit.

According to an embodiment of the present invention, the control unit is configured to control the defrost heater according to said pressure signal.

According to an embodiment of the present invention, the control unit is configured to activate the at least one defrost heater for a corresponding period of time.

According to an embodiment of the present invention, the control unit is configured to:

increase the duration of said corresponding period of time if the pressure signal is indicative of a decrease in the pressure inside said at least one storage compartment;

decrease the duration of said corresponding period of time if the pressure signal is indicative of an increase in the pressure inside said at least one storage compartment.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read by making reference to the attached drawings, wherein:

FIG. 1 illustrates a refrigerating appliance;

FIG. 2 schematically illustrates a simplified (not-in-scale) cross-sectional side view of the refrigerating appliance of FIG. 1 according to an embodiment of the present invention;

DETAILED DESCRIPTION OF PREFERRED EMBODIMENTS OF THE INVENTION

Figure 1:
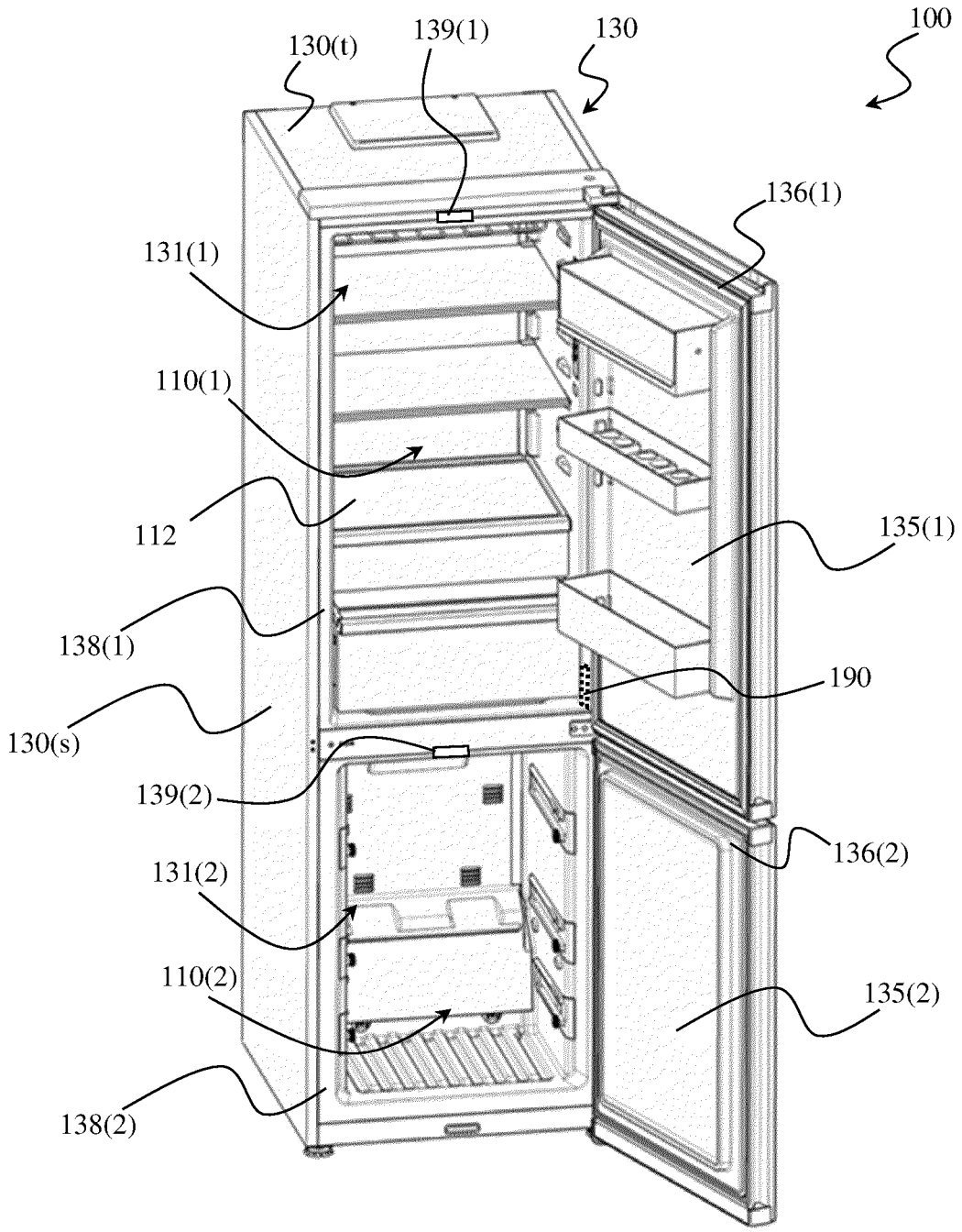

FIG. 1 illustrates a refrigerating appliance 100 in which concepts according to embodiments of the present invention can be applied.

The refrigerating appliance 100 comprises a number of well known electronic, mechanical and/or electro-mechanical components—however, for the sake of description ease and conciseness, only those being relevant for understanding the invention will be introduced and discussed in the following.

According to an embodiment of the present invention, the refrigerating appliance 100 is a combined-type refrigerating appliance, comprising a first storage compartment 110(1) and a second storage compartment 110(2) where food and beverage articles can be stored and preserved by refrigeration at different temperatures.

In the considered example, the first storage compartment 110(1) is a storage compartment adapted to operate at higher temperature than the second storage compartment 110(2).

For example, the first storage compartment 110(1) is a higher-temperature storage compartment, such as a fresh-food compartment, adapted to be at temperatures above 0° C. (e.g., in the range [3, 7] ° C.), and the second storage compartment 110(2) is a lower-temperature storage compartment, such as a freezer compartment, adapted to be at temperatures below 0° C. (e.g., in the range [−27, −18] ° C.). These temperature ranges have to be intended only as non limitative examples, since the concepts of the present invention can be directly applied to any range of temperatures, and also if the first and second storage compartments 110(1), 110(2) are both adapted to operate at temperatures below 0° C. or are both adapted to operate at temperatures above 0° C.

In the illustrated example, the first storage compartment 110(1) is positioned above the second storage compartment 110(2), however similar considerations apply in case the positions of the two compartments 110(1), 110(2) are swapped, or in case a single storage compartment only is provided.

Shelves 112 and other structures for supporting and storing food and beverage articles may be provided within both the first and second storage compartments 110(1), 110(2) (in the example illustrated in FIG. 1, only visible in the first storage compartment 110(1)).

According to an embodiment of the present invention, the refrigerating appliance 100 comprises a substantially parallepiped-shaped cabinet 130 having a top panel 130(*t*), a rear panel (not visible in FIG. 1), a bottom panel (not visible in FIG. 1), side panels 130(*s*) (only one visible in FIG. 1). Naturally, similar considerations apply in case the cabinet 130 has a different shape and/or structure.

In order to access the first and second storage compartments 110(1), 110(2), a front section of the cabinet 130 (i.e., the side thereof substantially perpendicular to the top panel 130(*t*), the bottom panel, and the side panels 130(*s*)) is provided with respective openings 131(1), 131(2). A first door 135(1) and a second door 135(2) are hingedly mounted to the front section of the cabinet 130 to selectively close/open the openings 131(1) and 131(2), respectively, in order to provide selective access to the first storage compartment 110(1) and to the second storage compartment 110(2), respectively. Different configurations can be also contemplated, such as for example in which a single door is provided for selectively closing/opening the openings 131(1) and 131(2), or in which the refrigerating appliance 100 has a single storage compartment only and a single door.

In FIG. 1, both the first door 135(1) and a second door 135(2) are depicted in an open condition.

According to a preferred embodiment of the present invention, the first door 135(1) comprises a gasket element 136(1) mounted along an inner peripheral portion of the first door 135(1), and configured to adhere with and remain flush with a corresponding border portion 138(1) of the front section of the cabinet 130 surrounding the opening 131(1) when the first door 135(1) is in the closed condition. In this way, air in the first storage compartment 110(1) is prevented from leaking out of the first storage compartment 110(1) through the opening 131(1) when the first door 135(1) is in the closed condition.

Similarly, according to a preferred embodiment of the present invention, the second door 135(2) comprises a gasket element 136(2) mounted along an inner peripheral portion of the second door 135(2), and configured to adhere with and remain flush with a corresponding border portion 138(2) of the front section of the cabinet 130 surrounding the opening 131(2) when the second door 135(2) is in the closed condition. In this way, air in the second storage compartment 110(2) is prevented from leaking out of the second storage compartment 110(2) through the opening 131(2) when the second door 135(2) is in the closed condition.

Without entering in details well known to those skilled in the art, the gasket elements 136(1) 136(2) are made of a deformable material, such as Polyvinyl chloride (PVC) or neoprene. Preferably, the gasket element 136(1) encloses magnetic material elements, e.g., magnetic strips, which are configured to be attracted toward the border portion 138(1), preferably by magnetic coupling elements 139(1) located at the border portion 138(1). Similarly, the gasket element 136(2) encloses magnetic material elements, e.g., magnetic strips, which are configured to be attracted toward the border portion 138(2), preferably by magnetic coupling elements 139(2) located at the border portion 138(2).

Figure 2:
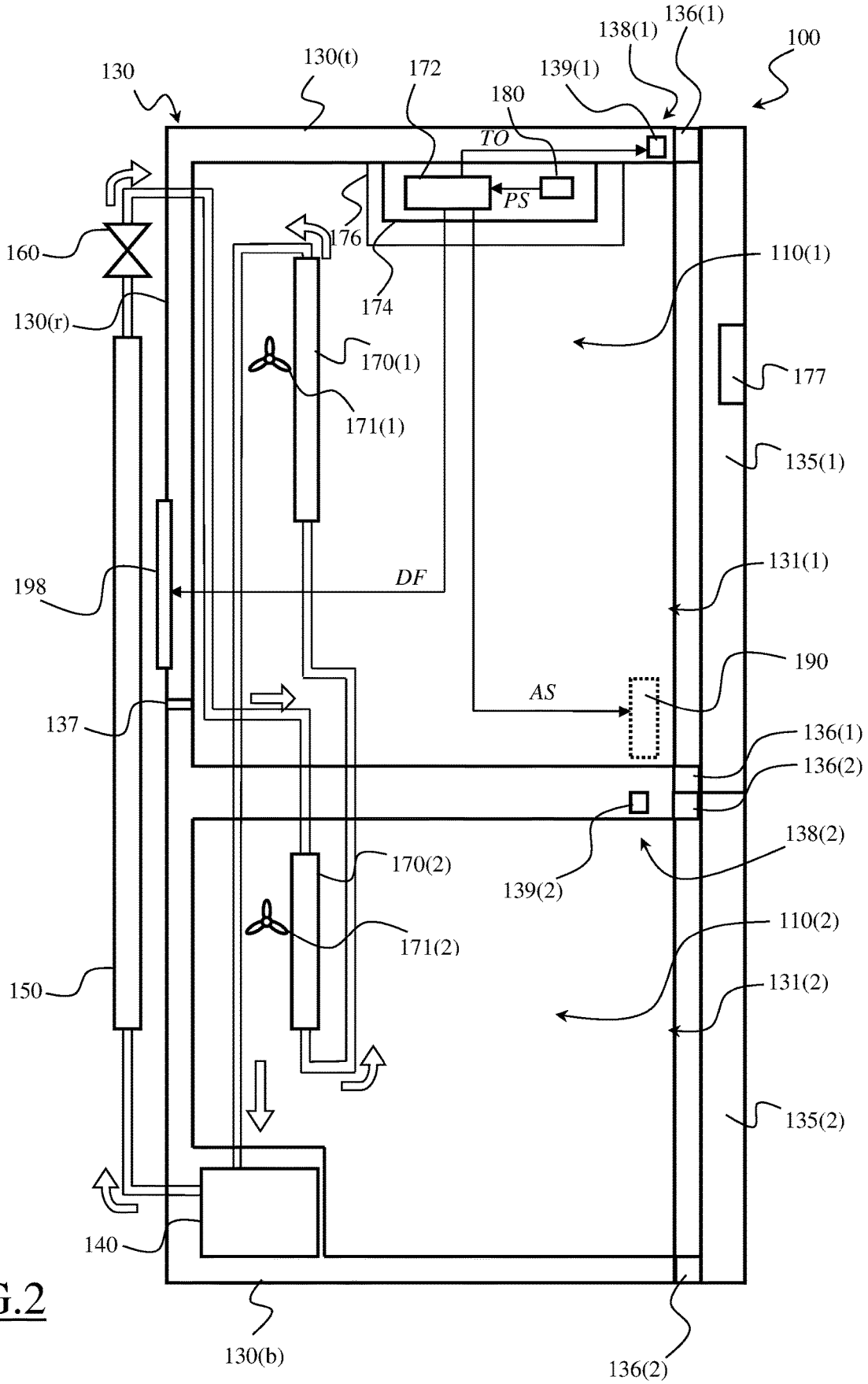

FIG. 2 schematically illustrates a simplified (not-in-scale) cross-sectional side view of the refrigerating appliance 100 taken from a section plane parallel to the side panels 130(*s*) according to an embodiment of the present invention.

In FIG. 2, the rear panel of the cabinet 130 is identified with reference 130(*r*), and the bottom panel of the cabinet 130 is preferably identified with reference 130(*b*).

In FIG. 2, both the first door 135(1) and a second door 135(2) are depicted in a closed condition, with the gasket element 136(1) that is flush with the border portion 138(1) and the gasket element 136(2) that is preferably flush with the border portion 138(2).

According to a preferred embodiment of the present invention, one or more vent holes 137 are provided (only one illustrated in FIG. 2), each one arranged to form a small and narrow passage through which (small amount of) air can pass between the external environment (i.e., external with respect to the refrigerating appliance 100) and the storage compartments 110(1), 110(2). The vent holes 137 are expediently used to (relatively slowly) bring back the pressure inside the storage compartments 110(1), 110(2) to the external ambient air pressure following pressure variations inside the storage compartments 110(1), 110(2) caused by perturbations (e.g., the opening/closing of one of the doors 135(1), 135(2)).

According to a preferred embodiment of the present invention, the refrigerating appliance 100 is equipped with a refrigeration circuit for circulating a refrigeration fluid (briefly referred to as "refrigerant").

According to an embodiment of the present invention, the refrigeration circuit comprises a compressor unit 140, a condenser unit 150, a fluid expansion unit 160, a first evaporator unit 170(1) associated to the first storage compartment 110(1), and a second evaporator unit 170(2) associated to the second storage compartment 110(2).

According to an embodiment of the present invention, the two evaporator units 170(1) and 170(2) are fluidly connected in series to each other in the refrigeration circuit, with the second evaporator unit 170(2) that is upstream the first evaporator unit 170(2) along the flow direction of the refrigerant in said refrigeration circuit (illustrated in the figures through bold arrows). It is pointed out that the concepts of the present invention can be directly applied to refrigerating appliances having a different kind of refrigeration circuit, such as for example a refrigerating appliance in which each storage compartment has a respective and independent refrigeration circuit or a refrigeration circuit having one evaporator only fluidically communicating with both compartments.

As it is well known to those skilled in the art, the compressor unit 140 carries out the double function of compressing the refrigerant and causing the circulation of refrigerant itself in the refrigeration circuit—so that the refrigerant flows, in sequence, through the condenser unit 150, the fluid expansion unit 160, the second evaporator unit 170(2), and the first evaporator unit 170(1), before reaching again the compressor unit 140.

According to a preferred embodiment of the present invention, the compressor unit 140 is located on a bottom portion of the refrigerating appliance 100, preferably close to the rear panel 130(*r*) of the cabinet 130.

According to a preferred embodiment of the present invention, the condenser unit 150 is provided on the rear portion of the refrigerating appliance 100, such as at the rear panel 130(*r*) of the cabinet 130.

According to an embodiment of the present invention, the first evaporator unit 170(1) is located at the first storage compartment 110(1), for example close to the rear panel 130(*r*), and the second evaporator unit 170(2) is located at the second storage compartment 110(2), for example close to the rear panel 130(*r*).

Naturally, the concepts of the present invention can be directly applied in case one or more among the compressor unit 140, the condenser unit 150, the fluid expansion unit 160, the first evaporator unit 170(1), and the second evaporator unit 170(2) are located in different positions of the refrigerating appliance 100, provided that the first evaporator unit 170(1) is arranged in such a way to be able of generating refrigerating air in the first storage compartment 110(1) and the second evaporator unit 170(2) is arranged in such a way to be able of generating refrigerating air in the second storage compartment 110(2).

The compressor unit 140 has an input port fluidly coupled with an output port of the first evaporator unit 170(1) for receiving refrigerant—in the vapor phase—at a relatively low temperature and at a relatively low pressure.

The compressor unit 140 has an output port fluidly coupled with an input port of the condenser unit 150.

The compressor unit 140 is configured to compress the refrigerant received by the first evaporator unit 170(1) so as to increase the pressure and temperature thereof, and to provide the compressed refrigerant to the condenser unit 150.

The compressed refrigerant, still in the vapor phase, flows through the condenser unit 150, wherein it condenses to liquid phase by heat exchange with ambient air.

The condenser unit 150 has an output port fluidly coupled with the fluid expansion unit 160 for providing the refrigerant, now in form of a high pressure liquid, to the latter unit.

The fluid expansion unit 160, for example an expansion valve or a capillary tube, is configured to reduce the pressure, and the temperature, of the refrigerant.

The refrigerant outputted by the fluid expansion unit 160—which is a low pressure, low temperature fluid in which liquid and vapor phase coexist—is fed to an input port of the second evaporator unit 170(2).

As the refrigerant flows through the second evaporator unit 170(2), part of the liquid fraction of the refrigerant turns from liquid into vapor through evaporation, causing air inside the second storage compartment 110(2) to cool down.

The refrigerant exits the second evaporator unit 170(2) through an output port thereof, that is fluidly coupled with an input port of the first evaporator unit 170(1).

As the refrigerant flows through the first evaporator unit 170(1), the remaining liquid fraction of the refrigerant turns from liquid into vapor through evaporation, causing air inside the first storage compartment 110(1) to cool down. Once the liquid fraction of the refrigerant is entirely turned into vapor, the temperature of the refrigerant starts to rise up.

The refrigerant—now in vapor phase—outputted from the output port of the second evaporator unit 170(2) is then fed again to the compressor unit 140.

Preferably, each of or one between the first evaporator unit 170(1) and the second evaporator unit 170(2) may be associated with a respective fan 171(1), 171(2) configured to promote heat exchange between the evaporator itself and the storage compartment associated to the evaporator.

According to an embodiment of the present invention, the compressor unit 140 is capable of setting the volume of refrigerant delivered per time unit (also referred to as "flow rate" or "throughput"), and therefore setting the temperature inside the storage compartments 110(1) and 110(2) under the control of a control unit 172 configured to control the operation of the refrigerating appliance 100.

Advantageously, if the refrigerating appliance 100 comprises at least one fan 171(1), 171(2), also the rotation speed thereof can be varied under the control of the control unit 172.

According to an embodiment of the present invention, the control unit 172 is located at one of the storage compartments 110(1) and 110(2).

In the exemplary embodiment of the invention illustrated in FIG. 2, the control unit 172 is provided on a circuit board 174 installed in (a top portion of) the first storage compartment 100(1). Preferably, a, e.g., plastic, shell 176 is provided to protect the circuit board 174 and the control unit 172.

According to an embodiment of the present invention, the circuit board 174 (and therefore the control unit 172) is electrically coupled with a plurality of electric and electronic components of the refrigerating appliance 100 by means of cables and wires, not illustrated in the figures. A non exhaustive list of said plurality of electric and refrigerating appliance electronic components comprises the compressor unit 140, the fan(s) 171(1), 171(2), and a user interface 177 through which a user may input commands to the control unit 172 (e.g., for setting the temperature inside the storage compartments 110(1) and 110(2)). Moreover, according to a preferred embodiment of the present invention, the control unit 172 is supplied by a corresponding power supply unit, not illustrated in the figures.

According to an embodiment of the present invention, the refrigerating appliance 100 comprises a pressure sensor 180 located inside one of the storage compartments 110(1), 110(2). In the embodiment of the invention illustrated in FIG. 2, the pressure sensor 180 is located in the first storage compartment 110(2), however, similar considerations apply if the pressure sensor 180 is located in the second storage compartment. Solutions are contemplated in which more than one pressure sensors 180 are provided, for example each one located in a respective storage compartment.

According to an embodiment of the present invention, the pressure sensor 180 is in signal communication with the control unit 172.

According to an embodiment of the present invention, the pressure sensor 180 is configured to output a corresponding pressure signal PS proportional to the measured pressure to the control unit 172.

According to an embodiment of the present invention, said pressure signal PS is a digital signal.

According to a preferred embodiment of the present invention, the pressure sensor 180 is a Micro Electro Mechanical System (MEMS) pressure sensor configured to measure the pressure inside the storage compartment 110(1), 110(2) wherein it is located.

According to an embodiment of the present invention, the pressure sensor 180 is a MEMS capacitive pressure sensor, comprising a first conductive layer deposed on a flexible diaphragm suspended over a cavity, and a second conductive layer deposed on the bottom of the cavity. In this way, a capacitor is formed, the electric capacitance thereof changing in response to deflections of the diaphragm caused by the pressure.

According to another embodiment of the present invention, the pressure sensor 180 is a MEMS piezoresistive pressure sensor, comprising piezoresistive conductive layers deposed on a suspended flexible diaphragm. The electric resistance of the piezoresistive conductive layers change in response to deflections of the diaphragm caused by the pressure.

According to an embodiment of the present invention, the (MEMS) pressure sensor 180 is an absolute pressure sensor, i.e., a pressure sensor having a single port, which is in fluid communication with the environment the pressure thereof is intended to be measured. In the exemplary embodiment of the invention illustrated in FIG. 2, this environment in fluid communication with said single port of the pressure sensor 180 is the first storage compartment **110(*i*)**.

Unlike a differential pressure sensor, the output of which is a difference between the pressure measured in two different environments (involving thus a relative measure), an absolute pressure sensor provides as output the value of the pressure of the environment in fluid communication with its single port with respect to the absolute vacuum pressure (involving thus an absolute measure). Therefore, the absolute pressure sensor 180 produces an output that is not influenced by the atmospheric pressure, i.e., a measure that is independent from the pressure outside the refrigerating appliance 100.

Using a pressure sensor 180 of the absolute type has several advantages compared to the known solutions exploiting pressure sensors of the differential type.

Indeed, unlike the differential pressure sensors, which require to be installed in such a way that a first port thereof is in fluid communication with a storage compartment of the refrigerating appliance, and a second port thereof is in fluid communication with the outside of the refrigerating appliance, the pressure sensor 180 according to the embodiments of the present invention does not need to have access to the outside of the refrigerating appliance 100.

Compared to a differential pressure sensor, the pressure sensor 180 according to the embodiments of the present invention can be installed with a much more easy and less time consuming operation.

Advantageously, the pressure sensor 180 according to the embodiments of the present invention does not require the installation of inconvenient tube elements for allowing the fluid communication of the sensor with two different environments (such as a storage compartment and the outside of the refrigerating appliance). Therefore, the solution according to the embodiments of the invention does not require the provision of additional holes to be provided in the cabinet 130 or on the doors 135(1), 135(2), since the pressure sensor 180 can be entirely located inside the refrigerating appliance 100.

Thanks to the intrinsic simplicity (from the interconnection point of view) of the pressure sensor 180 according to the embodiment of the present invention, the feasible locations for installing the pressure sensor 180 in the refrigerating appliance 100 are many, because an absolute pressure sensor does not require the provision of tube elements.

For example, according to an advantageous embodiment of the present invention, the pressure sensor 180 is advantageously mounted on the circuit board 174 where the control unit 172 is located. In this way, no complicated wiring is required for sending the pressure signal PS generated by the pressure sensor 180 to the control unit 172, since both the former and the latter are located on a same circuit board. Moreover, the pressure sensor 180 may by advantageously powered exploiting the same power supply used by the other components located on the circuit board 174, like the same power supply used for supplying the control unit 172.

Naturally, similar considerations apply in case the pressure sensor 180 is located in a different portion of the storage compartment 110(1) (or 110(2)). For example, the pressure sensor 180 can be installed in the same circuit board wherein Light-Emitting Diodes (LEDs) (not illustrated in the figures) for the illumination of the storage compartment 110(1) (or 110(2)) are provided.

According to an embodiment of the present invention, the control unit 172 is configured to control the operation of the refrigerating appliance 100 based on the pressure signal PS generated by the pressure sensor 180.

For example, according to an embodiment of the present invention, the control unit may be configured to set the flow rate of the compressor unit 140, and/or the flow rate (volume of air moved per time unit) of the fan 171(1), and/or of the fan 171(2) based on the pressure signal PS generated by the pressure sensor 180.

Moreover, by monitoring the pressure inside the storage compartment 110(1) and/or 110(2) through the pressure sensor 180, according to an embodiment of the present invention it is also possible to monitor the correct operation of the of the fan 171(1), and/or of the fan 171(2) during a test procedure at the end of the manufacturing process of the refrigerating appliance 100.

According to an embodiment of the present invention, the pressure inside the storage compartment 110(1) and/or 110(2) measured by the pressure sensor 180 may be also exploited to assess condensation/dew point conditions of the refrigerating appliance 100 during the operation thereof.

According to an embodiment of the present invention, the control unit 172 is advantageously configured to assess the condition (open condition or closed condition) of the door closing the opening for accessing the storage compartment wherein the pressure sensor is located according to the pressure signal PS generated by said pressure sensor 180.

In the embodiment of the invention illustrated in FIG. 2, wherein the pressure sensor 180 is located in the first storage compartment 110(1), the control unit 172 is configured to assess whether the door 135(1) is in the open condition or in the closed condition according to the pressure signal PS generated by said pressure sensor 180.

In a (not illustrated) embodiment of the present invention, if a pressure sensor is (also) provided inside the second storage compartment 110(2), the control unit 172 is (also) configured to assess whether the door 135(2) is in the open condition or in the closed condition according to the pressure signal PS generated by said pressure sensor.

By making reference to the embodiment of the invention illustrated in FIG. 2, according to an embodiment of the present invention, the control unit 172 is configured to asses that the door 135(1) is passing from the closed condition to the open condition when the pressure signal PS generated by the pressure sensor 180 is indicative of a decrease in the measured pressure.

Figure 3A:
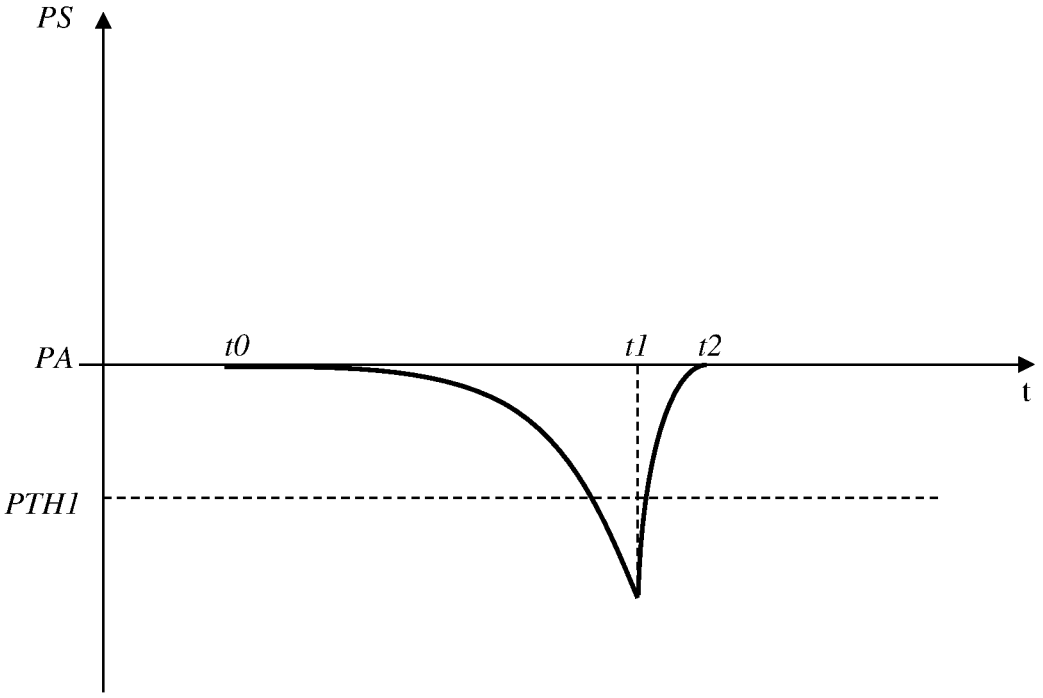
FIG. 3A illustrates an exemplary time evolution of a pressure signal generated by a pressure sensor according to an embodiment of the present invention installed in the refrigerating appliance of FIG. 2 during the opening of a door thereof.

FIG. 3A illustrates an exemplary time evolution of the pressure signal PS generated by the pressure sensor 180 according to an embodiment of the present invention during the opening of the door 135(1)—i.e., when the door 135(1) passes from the closed condition to the open condition.

The door 135(1) is initially in the closed condition, with the gasket element 136(1) of the first door 135(1) that is adhering with the border portion 138(1) of the front section of the cabinet 130 surrounding the opening 131(1). The closed condition is maintained by the magnetic coupling action between the magnetic material elements, e.g., magnetic strips, inside the gasket element 136(1) and magnetic coupling elements 139(1) located at the border portion 138(1).

In this situation, the pressure inside the first storage compartment 110(1) is preferably equal to the external ambient air pressure (because of the vent holes 137). Therefore, according to an embodiment of the present invention, in this situation the pressure signal PS generated by the pressure sensor 180 is equal to a steady value PA. According to an embodiment of the present invention, said steady value PA corresponds to the value of the external ambient air pressure. According to another embodiment of the present invention, said steady value PA corresponds to an average of the pressure inside said at least one storage compartment measured by the pressure sensor 180 within a predefined minimum time, for example equal to 5 seconds.

At time t0, a pulling force is applied to the door 135(1) (e.g., exerted by a user) for opening the latter. Since the door 135(1) is maintained in the closed condition by the magnetic coupling action between the magnetic strips inside the gasket element 136(1) and the magnetic coupling elements 139(1) located at the border portion 138(1), and since the gasket element 136(1) is made of a (relatively highly) deformable material, there is a transient period of time in which the opening 131(1) is still closed by the door 135(1), but the available volume for the air in the first storage compartment 110(1) is slightly increased. This slight increase in the volume causes a corresponding slight decrease in the pressure inside the first storage compartment 110(1). Since the MEMS pressure sensor 180 according to the embodiments of the present invention is advantageously configured to sense also small pressure variations, the pressure signal PS generated by the pressure sensor 180 will decrease with respect to the starting value PA.

When the gasket element 136(1) actually detaches from the border portion 138(1) at a subsequent time t1, air from the outside rapidly enters into the first storage compartment 110(1) through the opening 131(1), causing a fast rising of the pressure inside the first storage compartment 110(1) until reaching the value of the external ambient air pressure at time t2. Therefore, the pressure signal PS generated by the MEMS pressure sensor 180 according to the embodiments of the present invention will rapidly decrease, until returning back to the starting value PA at time t2.

It is pointed out that the width of said preferred vent hole(s) 137 is configured in such a way not to be sufficient to compensate the pressure decrease occurring between times t0 and t1.

According to an embodiment of the present invention, the control unit 172 is configured to assess that the door 135(1) is passing from the closed condition to the open condition when the pressure signal PS generated by the pressure sensor 180 falls from the starting value PA to a corresponding pressure threshold PTH1 in a time period TP=t1−t0 lower or equal than a corresponding time threshold TTH1. In this way, false positives, e.g., caused by slow pressure variations due to the fan 171(1) operations, are discarded. Exemplary values for the pressure threshold PTH1 can be a pressure value 10% less than the starting value PA, whereas the time threshold TTH1 can range from 0.1 to 5 seconds, preferably from 0.5 to 2 seconds.

By making reference again to the embodiment of the invention illustrated in FIG. 2, according to an embodiment of the present invention, the control unit 172 is configured to asses that the door 135(1) is passing from the open condition to the closed condition when the pressure signal PS generated by the pressure sensor 180 is indicative of an increase in the measured pressure.

Figure 3B:
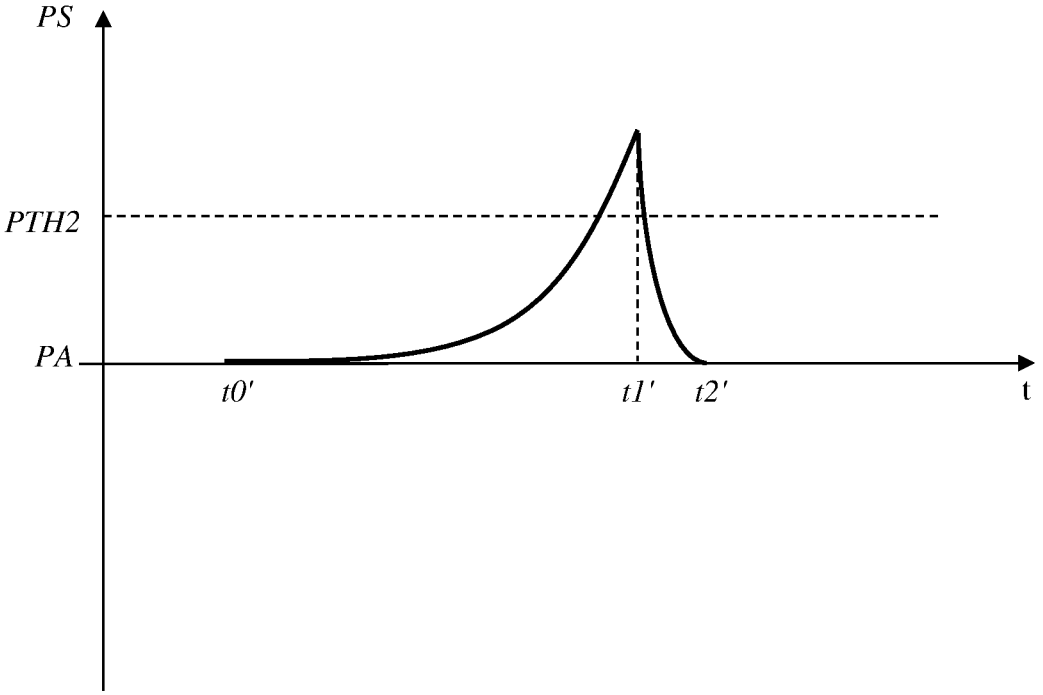
FIG. 3B illustrates an exemplary time evolution of a pressure signal generated by a pressure sensor according to an embodiment of the present invention installed in the refrigerating appliance of FIG. 2 during the closing of a door thereof.

FIG. 3B illustrates an exemplary time evolution of the pressure signal PS generated by the pressure sensor 180 according to an embodiment of the present invention during the closure of the door 135(1)—i.e., when the door 135(1) passes from the open condition to the closed condition.

The door 135(1) is initially in the open condition,

In this situation, the pressure inside the first storage compartment 110(1) is equal to the external ambient air pressure. Therefore, according to an embodiment of the present invention, in this situation the pressure signal PS generated by the pressure sensor 180 is equal to a steady value PA, for example corresponding to the value of the external ambient air pressure.

At time t0', the door 135(1) is closed by a pushing force applied to the door 135(1), bringing the gasket element 136(1) of the first door 135(1) into contact with the border portion 138(1) of the front section of the cabinet 130 surrounding the opening 131(1).

Since the gasket element 136(1) is made of a deformable material, there is a transient period of time after the closure (from time t0' to time t1') in which the available volume for the air in the first storage compartment 110(1) slightly decreases because of the compression of the gasket element 136(1) caused by the pushing force. This slight decrease in the volume causes a corresponding slight increase in the pressure inside the first storage compartment 110(1). Since the MEMS pressure sensor 180 according to the embodiments of the present invention is advantageously configured to sense also small pressure variations, the pressure signal PS generated by the pressure sensor 180 will increase with respect to the starting value PA.

Then, the gasket element 136(1) returns back to its initial shape, causing the available volume for the air in the first storage compartment 110(1) to increase, until reaching a steady value at time t2'. Therefore, the pressure signal PS generated by the MEMS pressure sensor 180 according to the embodiments of the present invention will decrease, until returning back to the starting value PA at time t2'.

According to an embodiment of the present invention, the control unit 172 is configured to assess that the door 135(1) is passing from the open condition to the closed condition when the pressure signal PS generated by the pressure sensor 180 rises from the starting value PA to a corresponding pressure threshold PTH2 in a time period TP=t1'−t0' lower or equal than a corresponding time threshold TTH2. In this way, false positives, e.g., caused by slow pressure variations due to the fan 171(1) operations, are discarded. Exemplary values for the pressure threshold PTH2 can be a pressure value 10% more than the starting value PA, whereas the time threshold TTH2 can range from 0.1 to 1 seconds, preferably from 0.5 to 1 seconds.

It has to be appreciated that the concepts of the invention described above in relation to the assessment of the open/closed condition of the door 135(1) by the control unit 172 according to the value of the pressure signal PS generated by the pressure sensor 180 can be applied to the door 135(2), provided that a pressure sensor 180 is installed within the second storage compartment 110(2).

Thanks to the proposed solution of using a MEMS pressure sensor 180, the control unit 172 is able to know the condition (open/closed) of the door 135(1) and/or 135(2), and accordingly control the operation of the refrigerating appliance 100 (e.g., by turning on/off lights inside the storage compartments, and/or by varying the flow rate of the compressor unit 140 and/or of the fans 171(1), 171(2)) in a very efficient and reliable way, without having to install complicated and cumbersome differential pressure sensors.

Moreover, since the MEMS pressure sensor 180 according to the embodiments of the present invention is very responsive, and capable of rapidly measuring pressure with a high precision, the control unit 172 is advantageously capable of rapidly assessing that the door 135(1) is passing from the closed condition to the open condition before the door 135(1) actually reached the open condition.

According to embodiments of the present invention, this early awareness can be advantageously exploited by the control unit 172 for aiding a user to open the door 135(1) and/or of the door 135(2). This feature can be particularly useful in case of refrigerating appliances having large and heavy doors.

For example, according to a preferred embodiment of the present invention, the refrigerating appliance 100 comprises a door actuator (e.g., an electric motor, schematically illustrated in FIG. 2 with a dashed block identified with reference 190) adapted to be driven by the control unit 172 for actuating the opening of the door 135(1). According to a preferred embodiment of the present invention, the control unit 172 is configured to drive the door actuator 190 by sending an actuation command AS to the latter when the pressure signal PS generated by pressure sensor 180 is indicative of a decrease in the pressure measured by the pressure sensor 180. Particularly, as soon as a user exerts a pulling force on the door 135(1) for opening the latter, a pressure decrease inside the first storage compartment 110(1) is rapidly sensed by the pressure sensor 180, which causes a corresponding decrease in the value of pressure signal PS provided to the control unit 172. In response to said decrease in the value of the received pressure signal PS, the control unit 172 sends an actuation command AS to the door actuator 190, which in turns starts to actuate the opening of the door 135(1). In this way, the user is advantageously helped during the opening of the door 135(1).

Similar considerations apply in case a (e.g., further) door actuator is provided for actuating the door 135(2), configured to be driven by the control unit 172 according to a pressure signal generated by a pressure sensor located in the second storage compartment 110(2).

According to a preferred embodiment of the present invention, the control unit 172 is configured to selectively deactivate the magnetic coupling elements 139(1) and/or 139(2) according to the pressure signal PS generated by the pressure sensor 180.

By making reference to example illustrated in FIG. 2, wherein the pressure sensor 180 is located inside the first storage compartment 110(1), and is configured to measure the pressure of the air inside said first storage compartment 110(1), the control unit 172 may be configured to keep activated the magnetic coupling elements 139(1) for causing the gasket elements 136(1) to adhere to the border portion 138(1) of the cabinet 130 when the door 135(1) is in the closed configuration, so as to prevent air in the first storage compartment 110(1) from leaking out from the first storage compartment 110(1). According to a preferred embodiment of the present invention, the control unit 172 is configured to deactivate the magnetic coupling elements 139(1) when the pressure signal PS generated by the pressure sensor 180 is indicative of a decrease in said measured pressure. Particularly, as soon as a user exerts a pulling force on the door 135(1) for opening the latter, a pressure decrease inside the first storage compartment 110(1) is rapidly sensed by the pressure sensor 180, which causes a corresponding decrease in the value of pressure signal PS provided to the control unit 172. In response to said decrease in the value of the received pressure signal PS, the control unit 172 deactivates the magnetic coupling elements 139(1) (for example by sending a deactivation command TO to the magnetic coupling elements 139(1)). In this way, the user is advantageously helped during the opening of the door 135(1), because the magnetic coupling effect generated by the magnetic coupling elements 139(1) is deactivated.

Similar considerations apply in case the magnetic coupling elements 139(2) are configured to be driven by the control unit 172 according to a pressure signal generated by a pressure sensor located in the second storage compartment 110(2).

Similarly, according to a preferred embodiment of the present invention, the control unit 172 is configured to selectively activate the magnetic coupling elements 139(1) and/or 139(2) according to the pressure signal PS generated by the pressure sensor 180. Starting from a condition in which the door 135(1) is in the closed configuration, and the magnetic coupling elements 139(1) are deactivated, according to an embodiment of the present invention the control unit 172 may be configured to activate the magnetic coupling elements 139(1) for favoring an adhesion of the gasket elements 136(1) to the border portion 138(1) of the cabinet 130 during the closure of the door 135(1) when the pressure signal PS generated by the pressure sensor 180 is indicative of an increase in said measured pressure.

According to an embodiment of the present invention, the refrigerating appliance 100 further comprises one or more defrost heaters (only one depicted in FIG. 2, and identified with reference 198) adapted to be driven by the control unit 172 to be (e.g., periodically) activated for melting frost formed on internal walls of the storage compartments because of dew. According to an embodiment of the present invention, the control unit 172 is configured to drive the defrost heater 198 by transmitting a defrost activation command DF to the latter for the activation thereof.

According to an embodiment of the present invention, the control unit 172 is configured to activate the defrost heater 198 (through the defrost activation command DF) and keep activated said defrost heater 198 for a corresponding time period (defrost period DP).

According to an embodiment of the present invention, the control unit 172 is configured to control the defrost heater 195 according to the pressure signal PS generated by the pressure sensor 180.

Since there is a relationship between the dew point temperature—i.e., the temperature below which water droplets begin to condense into dew—and pressure (the higher the pressure, the higher the dew point temperature), and since the formation of frost (also) depends on the amount of available dew, according to an embodiment of the present invention the control unit 172 is advantageously configured to control the defrost heater 198 by setting the duration of the defrost period DP according to the pressure signal PS generated by the pressure sensor 180.

For example, according to an embodiment of the present invention:

the higher the pressure inside the storage compartment (and therefore, the higher the pressure signal PS), the lower the duration the defrost period DP required to carry out an effective defrost operation, the lower the pressure inside the storage compartment (and therefore, the lower the pressure signal PS), the higher the duration the defrost period DP required to carry out an effective defrost operation.

For this reason, according to an embodiment of the present invention, the control unit 172 is configured to increase the duration of the defrost period DP during which the defrost heater 198 is kept activated if the pressure signal PS is indicative of a decrease in the pressure inside the storage compartment, and decrease the duration of the defrost period DP during which the defrost heater 198 is kept activated if the pressure signal PS is indicative of an increase in the pressure inside the storage compartment.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

For example, although in the embodiments of the invention herein described the refrigerating appliance comprises two storage compartments, the concepts of the present invention can be directly applied in case more than two storage compartments are provided.

The invention claimed is:

1. A refrigerating appliance comprising:

at least one storage compartment for storing goods to be refrigerated;

a refrigeration circuit configured to cool the at least one storage compartment;

a pressure sensor;

a control unit provided on a printed circuit board the control unit being electrically coupled to the refrigeration circuit and configured to control operation of the refrigerating appliance, the control unit being in signal communication with said pressure sensor; and at least one defrost heater in signal communication with the control unit, wherein:

said pressure sensor is a MEMS pressure sensor configured to measure the pressure inside said at least one storage compartment and to transmit to the control unit a corresponding pressure signal proportional to said measured pressure, the control unit being configured to control the defrost heater and the refrigeration circuit of the refrigerating apparatus based on the pressure signal received from the pressure sensor, and the control unit is configured to activate the at least one defrost heater for a corresponding period of time, the control unit being further configured to:

increase the duration of said corresponding period of time if the pressure signal is indicative of a decrease in the pressure inside said at least one storage compartment; and decrease the duration of said corresponding period of time if the pressure signal is indicative of an increase in the pressure inside said at least one storage compartment.

2. The refrigerating appliance of claim 1, wherein said pressure sensor is an absolute pressure sensor.

3. The refrigerating appliance of claim 1, further comprising:

at least one door configured to provide access to said at least one storage compartment when the at least one door is in an open condition and to prevent access to said at least one storage compartment when the at least one door is in a closed condition;

the control unit being configured to assess whether said at least one door is in the open condition or in the closed condition according to said pressure signal.

4. The refrigerating appliance of claim 1, wherein:

the refrigerating appliance comprises at least one door configured to provide access to said at least one storage compartment when the at least one door is in an open condition and to prevent access to said at least one storage compartment when the at least one door is in a closed condition;

the control unit is configured to assess that said at least one door is passing from the closed condition to the open condition according to said pressure signal.

5. The refrigerating appliance of claim 4, wherein the control unit is configured to assess that said at least one door is passing from the closed condition to the open condition when the pressure signal falls from a steady value to a corresponding lower first pressure threshold value in a time period lower or equal than a corresponding first time threshold.

6. The refrigerating appliance of claim 5, wherein said steady value is a selected one between:

a value corresponding to an external ambient pressure value, and a value corresponding to an average of the pressure inside said at least one storage compartment measured by the pressure sensor within a predefined minimum time.

7. The refrigerating appliance of claim 4, further comprising:

a cabinet enclosing said at least one storage compartment;

a gasket element mounted along an inner peripheral portion of the at least one door;

a magnetic strip configured to be activated by the control unit for causing said gasket element adhere to a corresponding portion of the cabinet when the at least one door is in the closed condition so as to prevent air in the at least one storage compartment from leaking out of the at least one storage compartment, wherein:

the control unit is configured to deactivate the magnetic strip when the pressure signal is indicative of a decrease in said measured pressure.

8. The refrigerating appliance of claim 1, wherein:

the refrigerating appliance comprises at least one door configured to provide access to said at least one storage compartment when the at least one door is in an open condition and to prevent access to said at least one storage compartment when the at least one door is in a closed condition;

the control unit is configured to assess that said at least one door is passing from the open condition to the closed condition according to said pressure signal.

9. The refrigerating appliance of claim 8, wherein the control unit is configured to assess that said at least one door is passing from the open condition to the closed condition when the pressure signal rises from a steady value corresponding to an external ambient pressure value to a corresponding higher second pressure threshold value in a time period lower or equal than a corresponding second time threshold.

10. The refrigerating appliance of claim 1, further comprising:

at least one door configured to provide access to said at least one storage compartment when the at least one door is in an open condition and to prevent access to said at least one storage compartment when the at least one door is in a closed condition;

a motor configured to be driven by the control unit for actuating the opening of said at least one door when the pressure signal is indicative of a decrease in said measured pressure.

11. The refrigerating appliance of claim 1, wherein said pressure signal is a digital signal.

12. The refrigerating appliance of claim 1, wherein said printed circuit board is provided inside said at least one storage compartment, said pressure sensor being mounted on said printed circuit board.

13. The refrigerating appliance of claim 1, wherein said at least one storage compartment comprises a fresh food compartment and a freezer compartment, said pressure sensor being located inside said fresh food compartment and/or in said freezer compartment.

* * * * *